US007459675B1

(12) United States Patent
Kroska

(10) Patent No.: US 7,459,675 B1
(45) **Date of Patent: *Dec. 2, 2008**

(54) MASS SPECTROMETER IONIZATION SOURCE

(76) Inventor: John D. Kroska, 23960 Filmore St. NE., Betel, MN (US) 55005

( * ) Notice: Subject to any disclaimer, the term of this patent is extended or adjusted under 35 U.S.C. 154(b) by 85 days.

This patent is subject to a terminal disclaimer.

(21) Appl. No.: 11/101,292

(22) Filed: Apr. 7, 2005

Related U.S. Application Data

(63) Continuation of application No. 10/435,312, filed on May 9, 2003, now Pat. No. 6,878,932.

(51) Int. Cl.
*H01J 49/04* (2006.01)

(52) U.S. Cl. ..... 250/288

(58) Field of Classification Search ..... None
See application file for complete search history.

(56) References Cited

U.S. PATENT DOCUMENTS

| | | | |
|---|---|---|---|
| 4,659,438 | A | 4/1987 | Kuhn et al. |
| 4,755,265 | A | 7/1988 | Young |
| 5,055,678 | A | 10/1991 | Taylor et al. |
| 5,083,450 | A | 1/1992 | Grindstaff |
| 5,217,586 | A | 6/1993 | Datta et al. |
| 5,400,665 | A | 3/1995 | Zhu et al. |
| 5,406,318 | A | 4/1995 | Moore et al. |
| 5,437,179 | A | 8/1995 | Wegand et al. |
| 5,589,630 | A | 12/1996 | Wegand et al. |
| 5,601,785 | A | 2/1997 | Higdon |
| 5,686,656 | A | 11/1997 | Amirav et al. |
| 5,702,671 | A | 12/1997 | Gerstel |
| 5,736,739 | A | 4/1998 | Uber et al. |
| 5,778,681 | A | 7/1998 | Li et al. |
| 5,796,100 | A | 8/1998 | Palermo |
| 5,903,344 | A | 5/1999 | Reedy |
| 5,970,804 | A | 10/1999 | Robbat et al. |
| 6,037,587 | A | 3/2000 | Dowell et al. |
| 6,125,709 | A | 10/2000 | Van Der Maas |
| 6,150,279 | A | 11/2000 | Ku |
| 6,412,751 | B1 | 7/2002 | Wang |
| 6,498,042 | B1 | 12/2002 | Wilson |
| 6,621,076 | B1 | 9/2003 | van de Goor et al. |
| 6,878,932 | B1 * | 4/2005 | Kroska ..... 250/288 |
| 2002/0158016 | A1 | 10/2002 | Norberg et al. |

* cited by examiner

*Primary Examiner*—Jack I. Berman
(74) *Attorney, Agent, or Firm*—William R. Berggren

(57) ABSTRACT

An improved ionization source for a mass spectrometer is constructed of a subsurface of metal that has a smooth surface obtained by, for example, electropolishing, and an inert surface thin enough to have a surface finish opposing the subsurface that replicates that of the subsurface. Preferably the inert surface has a thickness that is less than 0.001 inches and is gold. Operation of a mass spectrometer with the improved ionization source results in reduced adsorption and reduced reactions between charged molecules or ions and metallic surfaces. Micro-machining of the subsurface metal before electropolishing enhances smoothness and decreases resulting debris collection on the improved ionization source. The improved ionization source remains serviceable for longer periods and is easier to clean and recondition for continued use as compared to known mass spectrometer ionization sources.

18 Claims, 4 Drawing Sheets

MASS SPECTROMETER IONIZATION SOURCE

CROSS-REFERENCE TO RELATED REFERENCES

This application is a continuation of application Ser. No. 10/435,312, filed May 9, 2003, U.S. Pat. No. 6,878,932.

FIELD OF THE INVENTION

This invention relates to improvements in mass spectrometry and improvements in ion sources, their sensitivity, and their cleaning.

BACKGROUND

Improvements are needed in mass spectrometry and more specifically improvements to an ionization source to allow analysis that is more sensitive and provide other analytical and operational advantages.

Mass spectrometer (MS) instruments analyze compounds and mixtures by measuring the mass-to-charge ratio (M/Z) of ionized molecules generated at a source. MS instruments vaporize and ionize a sample and determine the mass-to-charge ratio of the resulting ions. Quadrupole, time-of-flight (TOF) and ion trap are types of mass spectrometers.

An MS system generally consists of a chromatograph (gas or liquid) or alternate device to introduce an analyte for analysis; an ionization source with a chamber to produce ions from the analyte; a mass analyzer or filter to separate ions according to their mass-to-charge ratio; a detector to measure ion abundance; and an instrument control and data-handling system to produce a mass spectrum of the analyte.

In the operation of an MS instrument, an ionization source generates charged molecules for mass identification. Ionization sources useful in mass spectrometry include, for example electron impact (EI), chemical ionization (CI), negative chemical ionization (NID), fast ion or atom bombardment, field desorption, laser desorption, plasma desorption, thermospray, electrospray and inductively coupled plasma. A problem typically encountered with an EI ionization source has been that the mechanical components of a conventional EI ionization source use a magnetic or electrical field to focus ions to the filter or analyzing point. These mechanical components tend to be ignored, as the analyte is not analyzed in the source. However, it would be preferable to generate the charged molecules while maintaining inertness and mechanical integrity throughout the ion source.

A quadrupole consists of four conductive rods that with the proper application of radio frequency and direct current ramped energy fields create a tunable mass filter allowing only the ions of the selected mass-to-charge ratio to transit. Ions are injected on one side from the ion source and filtered by the rods. Those that meet the proper mass-top-charge ratio are allowed to pass and create a mass spectrum on a time axis.

A time-of-flight (TOF) MS instrument determines the mass-to-charge ratio of an ion by measuring the amount of time it takes a given ion to migrate from the ion source to the detector, under influence of electric fields. TOF MS instruments accelerate a pulsed ion beam across a nearly constant potential and measure the flight time of ions from their origination at the source to a detector. Since the kinetic energy per charge of an ion is nearly constant, heavier ions move more slowly and arrive at the detector later in time than lighter ions. Using the flight times of ions with known M/Z values, the TOF spectrometer is calibrated and the flight time of an unknown ion is converted into an M/Z value. TOF MS instruments have been primarily used with pulsed sources generating a discrete burst of ions. Examples of MS instruments with pulsed sources include plasma desorption MS instruments and secondary ionization MS instruments. Ionization methods include matrix assisted laser desorption/ionization (MALDI) and electrospray ionization (ESI).

An ion trap MS instrument has a ring electrode and a pair of end cap electrodes, which form an ion trap region. The ion trap MS instrument operates with an electron impact (EI) ion source including an ionization step and a mass-analyzing step. In the ionization step, a sample in an ion trap region ionizes by collision with electrons, and resulting ions accumulate in the ion trap region. In the a mass analyzing step, the ion trap region consecutively ejects accumulated ions by radio frequency (RF) voltage scanning applied to the electrodes, and a detector detects the ejected ions.

Ionization sources operate in a similar manner. An analyte in gaseous or liquid form is introduced into the chamber containing the ionization source, and the ionization source partially ionizes the analyte. As previously mentioned, illustrative ionization sources useful in mass spectrometry include, for example: EI, CI, NID, fast ion or atom bombardment, field desorption, laser desorption, plasma desorption, thermospray, electrospray and inductively coupled plasma. Two accepted and widely used ionization sources to create ions in MS instruments are EI and CI ionization sources.

In an EI ionization source of a conventional MS instrument, introduction of an electron beam creates charged molecules. The EI source generally contains a heated filament to emit electrons that accelerate toward an anode and collide with gaseous analyte molecules introduced into the ionization chamber. The beam of emitted electrons focuses in the ionization chamber where the analyte is introduced. Typically, relatively high-energy electrons (of about 70 eV) collide with molecules of the subject analyte, producing ions with an efficiency of less than a few percent. These collisions produce primarily positive ions. Upon ionization, the molecules of a given substance fragment in predictable patterns. The resultant ions separate by their mass-to-charge ratio in the mass analyzer or filter and collect in the detector. EI is a direct process; energy transfers collisionally from electrons to analyte molecules. Total pressure within the EI ionization source is normally less than about $10^{-3}$ torr. The ions produced are extracted from the EI source with an applied electric field and generally do not collide with other molecules or surfaces from their formation in the EI source until their collection in the detector.

The surfaces of the analyte area or chamber containing the ionization source are highly susceptible to analyte absorption. Molecular interactions between the products of the introduced analyte and the surfaces of the chamber and the ionization source can distort the true quantity and quality of the presented analyte. Due to temperature, vacuum, and electrical considerations, metal surfaces (such as stainless steel) have typically been used for construction of the ionization source. It has long been desired to provide a greater degree of mechanical isolation between the charged ions of the analyte and the adsorptive surfaces of the chamber and the ionization source.

In all ion sources, it has not been thought necessary to prevent adsorption, degradation or decomposition of analyte ions or to prevent adverse reactions of gaseous ions on the surface of the sources. Any such secondary ions have not been thought to affect the intended measurement.

After formation of ions in the ionization source, five basic types of mass analyzers or filters are available for ion separation, including magnetic, electrostatic, time-of-flight, ion cyclotron resonance, quadrupole, and variations of the quadrupole. Typical detectors used in MS instruments are discrete and continuous dyanode electron multipliers.

Other workers have made efforts to address analyte degradation problems in an MS ionization chamber by substituting or modifying ionization chamber surfaces. For example, chromium or oxidized chromium surfaces in an analyte analyzing and ionizing apparatus, such as an ion trap or ionization chamber, have been used to prevent degradation or decomposition of an analyte in contact with those surfaces. An inert, inorganic, non-metallic insulator or semiconductor coating material on the ion trap or ionization chamber interior surfaces has been used to reduce adsorption, degradation or decomposition of an analyte in contact with the surface. Silicon coated steel has also been used in place of certified stainless steel with some reported improvement in results. Furthermore, coating the inner surface of the ionization with chamber materials known for corrosion resistance or inertness, such as nickel, rhodium, and the like, may retard degradation of some analytes.

Other attempts to prevent degradation problems involve treating the inner metal surfaces of the analytical apparatus with a passivating agent to mask or destroy active surface sites. For example, gas chromatographic injectors, chromatographic columns, transfer lines, and detectors have been treated with alkylchlorosilanes and other silylizing agents. Such treatments have had some success in deactivating metal surfaces and preventing degradation. Unfortunately, the materials used for such treatments have sufficiently high vapor pressure, produce gas phase organic materials within the ionization chamber volume, and ionize along with the analyte, producing a high chemical background in the mass spectrum. MS instruments using such ionization chambers give variable results and do not completely prevent analyte degradation over time.

In addition to metal surface degradation problems just described, currently available ionization sources tend to corrode or degrade over extended periods and require cleaning and reconditioning for continued use. Often cleaning procedures include aggressive mechanical abrading procedures that can stress, deform or even break affected portions of the ionization source. Such procedures result in extended equipment downtime and often result in breakage of the involved parts, requiring costly replacement.

SUMMARY OF THE INVENTION

I have invented an improved ionization source that permits detection of smaller quantities of ion fragments and is easier to clean. The source comprises an ionization element with a surface that is chemically inert and is smoother than previously known surfaces of ionization elements, wherein the ionization source is less prone to analyte contamination than those previously know.

Also disclosed is an improved ionization source having a surface comprises an upper surface having a first finish, the finish smoother than those previously known to ionization sources. The surface also comprises a top surface that is chemically inert and has an underside adjacent to first finish and a top side opposed to first finish. The finish of the top side substantially replicates the first finish.

Also disclosed are methods of making the ionization source, methods of operating the ionization source and methods of cleaning the ionization source of the structure disclosed above.

Benefits of the ionization source include less adsorption of ionization products on the ionization element surface. This results in greater ability to detect more minute components. It also results in the ability to more easily clean the source of adsorbed or decomposed analyte.

DETAILED DESCRIPTION OF THE INVENTION

Figure 1:
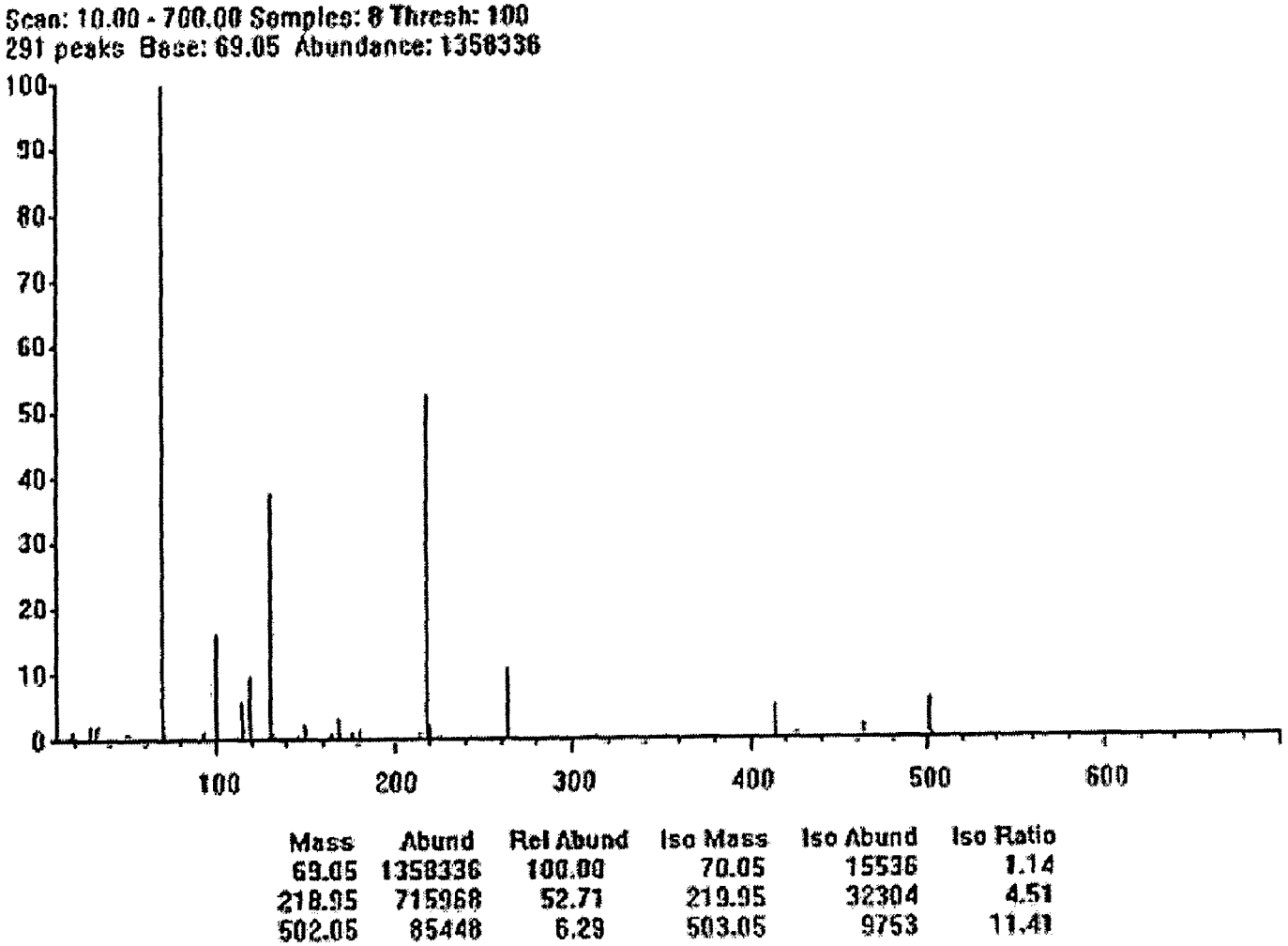
FIG. 1 is a graph showing analysis of a standard calibration compound using a conventional stainless steel EI ionization source in a MS instrument.

The improved ionization source requires an ionization element with a smooth inert surface not previously known or suggested as a surface of an ionization source. While the entire surface could be inert and could be smoothed with a finish known to metallurgy, it is preferable that the surface comprise a subsurface and a top surface. The subsurface should have an upper surface with a first finish that is smoother than those previously known to ionization sources. The surface is chemically inert and has an underside proximate to first finish and topside opposed to first finish and with a topside finish that substantially replicates the first finish. An ionization element is a conductive metal surface able to come in contact with ionization products of analyte during the ionization process under the energetic conditions of ion formation. Ionization sources include, for example, the source is selected from electron impact, chemical ionization, negative chemical ionization, fast ion and atom bombardment, field desorption, laser desorption, plasma desorption, thermospray, electrospray, and inductively coupled plasma ionization source.

Smoothing finishes are not generally used on surfaces of ionization elements. Satisfactory finishes include, for example, electropolished, chemical passivation polished, mechanical abrasive polished, cylindered, honed, and metal-to-metal polished finishes. The smoothness of upper surface of the subsurface is further enhanced by the subsurface having an under surface beneath and proximate the first finish, the under surface having a finish comprising a micro-machined finish.

The inert top surface is then applied in a manner sufficient to permit substantial replication of the first finish onto the inert top side opposing the upper side of the subsurface. If the inert surface is applied in a thickness that is sufficiently thin, the inert surface would have a smoothness that substantially replicates that of the finish of the subsurface. The inert surface may be of any material that is conductive and unreactive to analyte, carrier chemicals and cleaning chemicals used with MS. Inert materials include, for example, gold, platinum, chromium, nickel and mixtures and alloys thereof. Where the inert surface is electroplated gold, the thickness is less than 0.001 inches, preferably less than 0.0001 inches. Similar thicknesses are believed to be satisfactory for inert materials other than gold. It is also found that the inert surface is smoother if the subsurface is first micro-machined before a smoothing finish is applied.

An embodiment of this invention concerns improvements to an ionization source or other source of ions for an MS, such as an EI ionization source. For this embodiment, smoothing of the subsurface will be done by electropolishing and the inert surface will be gold. Methods of making using and cleaning will be disclosed with this embodiment. It will be apparent to those skilled in the art how to make, use and clean other embodiments of the invention such as those made from other smoothing techniques or using other inert surfaces.

Ionization sources of the invention also may be made substantially of the inert material that is, in turn, smoothed directly to achieve the advantages mentioned. However, this is often expensive and may be less preferred.

It has been discovered that by electropolishing the surface of a stainless steel ionization source and then electroplating the electropolished surface with a thin enough layer of gold to permit replication of the electropolished surface on the gold surface opposing the polished surface, the surface of the ionization source is more stable and smoother than comparable ionization sources and evidences less interaction with analytes. The use of the electropolished and gold-electroplated stainless steel ionization source reduces analyte adsorption, degradation or decomposition and reduces adverse reactions of gaseous ions on the chamber inner surfaces to improve MS instrument performance. In addition, the electropolished and gold-electroplated stainless steel ionization source can be used for longer periods before requiring cleaning and rehabilitation, and cleaning is a simplified procedure that avoids abrasive techniques without regard to operating conditions.

This superior performance at conditions including convention al operating conditions was surprising for several reasons. Ionization sources made from gold plated onto stainless has been taught. Grinstaff, in U.S. Pat. No. 5,083,450, taught of a source made with gold plated onto stainless steel. The gold was applied in a thick layer of 3 mils and had to be deactivated by subsequent acid wash and silicate treatment. Even then, the coating was rendered prone to contamination if not operated at temperatures much lower than that of conventional systems. A 3 mil gold plated surface is generally unsatisfactorily rough without other steps. The need or benefit of smoothness of the gold surface was neither taught nor suggested.

Ionization sources have also been taught with inert conductive coatings, such as gold, applied by various methods, including electroplating, onto stainless steel to improve ion transport. No mention was made of the need or value of the smoothness of the inert surface.

Electroplating gold onto electropolished stainless steel has been known to improve the adhesion of gold to stainless steel and increase scratch resistance. However, improved scratch resistance has not been recognized as a need for ionization sources. Thus, the benefits that I found of applying gold to an electropolished stainless steel surface were unanticipated and unknown in regards to ionization sources.

The benefits were known of using ionization sources with surfaces inert to the acid used in passivation. Methods of cleaning of ionization sources known to the art generally involved physical abrasion steps and solvent rinse steps, typically under ultrasonic conditions. Using acid to clean ionization sources generally is avoided because of likely damage to any metal subsurface. References teaching ionization sources with surfaces inert to acids do not teach or suggest the importance of smooth surfaces to avoid the need for concurrent physical abrasion in cleaning methods.

The presently described novel MS ionization source embodiment has a very smooth and inert surface and maintains enhanced inertness over extended periods of use. As used throughout this description and in the appended claims, the terms "ionization chamber," "ionization source," "source of ions," and the like terms may be used interchangeably and are intended to be given their broadest interpretation. These terms are to be understood to define any structure that will generate ions from an analyte or analysis standard by fragmentation for detection within an MS.

This improved ionization source embodiment is prepared by constructing an ionization source of the desired configuration from non-magnetic stainless steel. The stainless steel used may be a certified grade of 303 non-magnetic surgical stainless steel. Stainless steel is preferably micro-machined to enhance the ultimate surface smoothness of the ion source. Micro-machining is by any industry standard micro-machining technique, such as machining or "turning off" the outer stainless steel layer (sometimes referred to as the "bark") and then heat-treating the micro-machined blank. The micro-machined blank is heat treated or stabilized by any industry standard technique. Suitably, the micro-machined blank can be heated to an elevated temperature, for example, about 300° to about 350° C. for about 2 hours. After cooling, standard techniques, including lathe turning, are used to complete the desired configuration of the ionization source. The microfinish of the ionization source should be of grade 16 or better, so the resulting final smoothness is improved and adverse interactions with adsorbed analyte products can be minimized.

Any industry standard electropolishing method is then used to electropolish the ionization source. For example, a suitable electropolishing method involves applying a current in an acid bath to remove surface materials. Other suitable methods of polishing include chemical passivation polishing, mechanical abrasive polishing, cylindering, honing, and metal-to-metal polishing. The steel used for the ionization source must contain nickel or chromium in order to be electropolished. The resulting surface is very smooth and bright, and the chromium component of the stainless steel is readily seen.

Electropolishing is electrolytic removal of metal in a highly ionic solution by electrical potential and current. Electropolishing removes a very thin material layer from a metal part or component. The process enhances workpiece material properties and changes physical dimensions, depending upon the metal itself and processing before electropolishing. Most ferrous and non-ferrous metals can be electropolished. Electropolishing smoothes and levels most metal surfaces, improving visual appearance and creating the smooth subsurface that translates to the inert surface that is later applied. Smoothing levels metal grain boundaries, removes sites for potential stress cracking, and enhances a part's strength.

In electropolishing of stainless steel, a stainless steel workpiece connects to the positive side of an electrical rectifier and functions as an anode. The workpiece is placed in an electropolishing bath, usually comprising phosphoric and sulfuric acid. The cathode connects to the rectifier negative end to receive metal ions from the workpiece. A thick viscous electropolishing solution film, known as anode film, forms on the workpiece surface during electropolishing. Metal dissolves anodically through a highly polarizing film in steady-state metal ion removal.

As current is applied to the workpiece anode, the electropolishing solution thickens and functions as an insulator or resistor. Greater film thickness leads to higher resistance or insulation properties. The metal closest to the workpiece surface has a very thick anode solution film and is electrically insulated from the cathode. Higher surface irregularities or peaks protrude from the work surface through the anode film. The highest peaks have the least insulation from the anode film and receive a proportionally greater current from the cathode, dissolving faster than lower peaks. Medium peaks receive a lower current than the higher peaks and dissolve more slowly. The differential dissolution rates create the electropolishing leveling effect.

Electropolishing removes metal surface high spots or peaks. Higher peak dimensions change drastically while lower valley dimensions change very little, creating a metal surface smoothing effect. Workpiece dimensional reduction can form a substantially smoother surface. Resulting irregularities can by very small with peak to neighboring valley dimensions of less than 0.001 inches, preferably less than 0.0005 inches and more preferably less than 0.00025 inches.

Following electropolishing, a DI water rinse removes the polarizing film.

Electropolishing stainless steel also removes free iron from the workpiece surface, eliminating free iron corrosion, and enriching the surface with chromium and nickel. Chromium forms a chromium oxide passivation layer over the metal surface adding corrosion resistance.

When the inert surface to be later applied is gold, the resulting electropolished ionization source is then nickel flashed by any industry standard nickel flashing method. Illustratively, immersing the ionization source in a bath of hydrochloric acid with application of a small-pulsed current is a suitable nickel flashing method. Nickel flashing of the electropolished stainless steel ionization source is beneficial before the following gold electroplating. Typically, the nickel flashing should have a thickness of no more than about 0.000001 inch or thinner.

The final step in constructing an embodiment of the improved ionization source of this invention is gold electroplating. Any industry standard method of electroplating gold may be used and a suitable thickness of the gold finish is one that permits replication of the smooth electropolished stainless steel onto the gold surface opposing the electropolished stainless steel. If gold is electroplated too thick, whiskers and filaments of an unsatisfactory size tend to form causing the surface of gold to be unsatisfactorily rough. If the surface is too rough, analyte product adsorption is not decreased over that of conventional ion sources and cleaning generally required a physical abrasion step. While subsequent electropolishing of the gold surface could be done, this is expensive, difficult to perform, and unnecessary if the initial thickness of gold is sufficiently thin.

Gold application characteristics have been discovered for improved ionization sources. Satisfactory thickness of electroplated gold has been found to be less than 0.001 inches, preferably less than 0.0001 inches and most preferably from about 0.000030 inch to about 0.000050 inch. Suitable gold-plating techniques include electrodeposition and sputtering. Gold plating of the electropolished stainless ionization source provides enhanced inertness and smoothness. Gold plating of the interior ion chamber surfaces of the ionization source (i.e., the analyte-contacting surfaces) provides the inertness and other desired advantages reported above. However, gold plating only the ion chamber would be a more expensive and complicated procedure, requiring such time-consuming and expensive techniques as masking of the ionization source exterior surfaces. In addition, gold plating of the entire ionization source simplifies cleaning the ionization source, described further below.

Several unexpected benefits have been observed to result from the use of an embodiment of a novel ionization source of this invention in place of a conventional ionization source. Use of the improved ionization source allows high mass throughput efficiency for the analyte or analysis standard. The improved ionization source can remain in service in an MS for longer periods, has greater inertness and is easier to clean than a conventional ionization source. For example, FIGS. 1 through 4, as further described below, serve to illustrate benefits observed from use of the electropolished, gold-electroplated EI ionization source embodiment of this invention in place of a conventional stainless steel EI ionization source in an MS instrument.

FIG. 1 is a graph showing analysis of FC43, a standard calibration compound, using a conventional stainless steel EI ionization source in a 5973A MS instrument, manufactured by Agilent Technologies, Wilmington, Del. FC43 is chemically identified as perfluorotributylamine. In the legend below the graph, "MASS" is the fragmentation of FC43, "ABUND" is the raw mass fragmentation counts of FC43, "REL ABUND" is the percentage of efficiency of fragmentation and transmission from the source to the analyzer of FC43, "ISO MASS" is the isotope mass of $C_{13}$, and "ISO RATIO" is the isotope ratio of $C_{12}$ to $C_{13}$.

Figure 2:
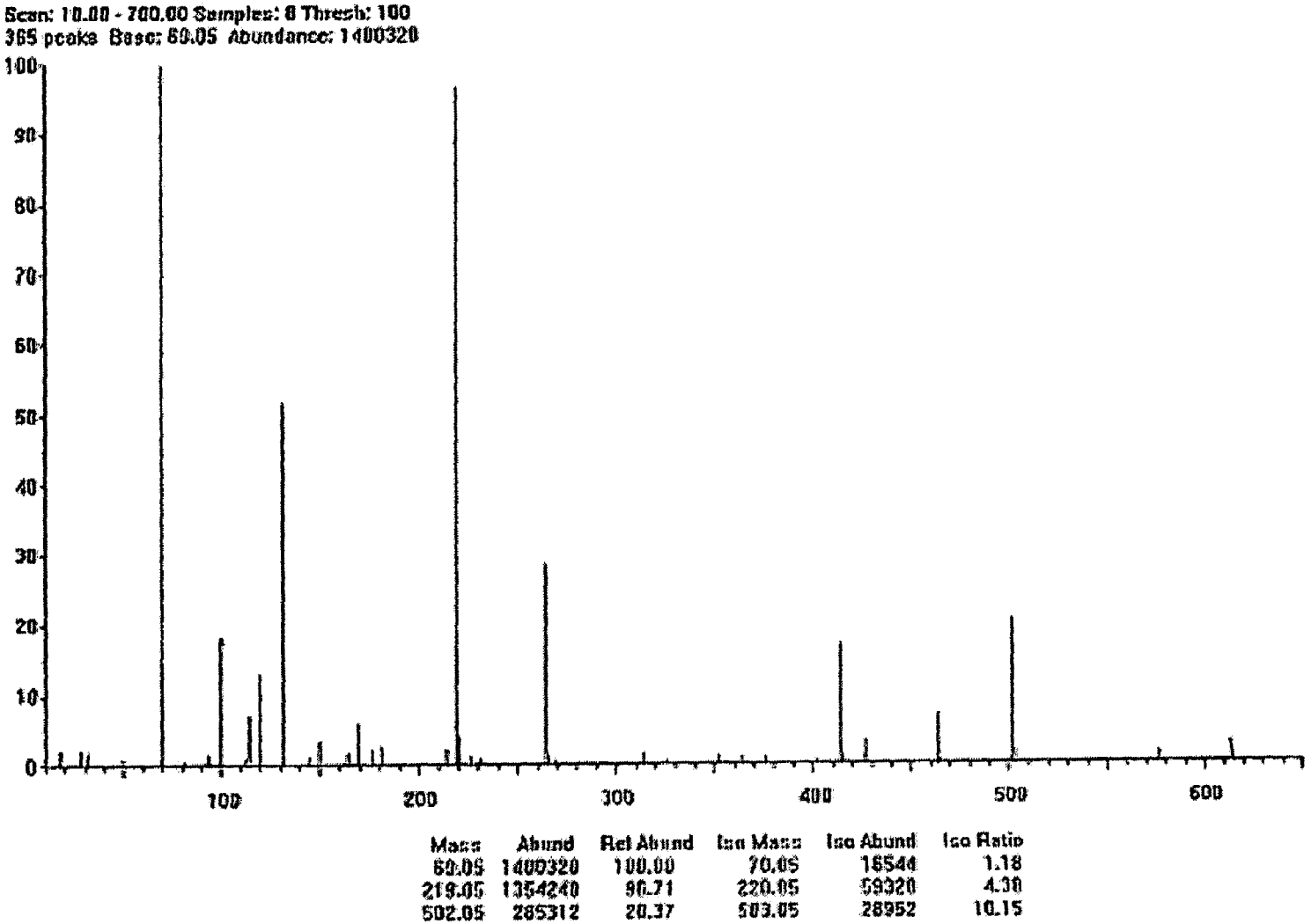
FIG. 2 is a graph showing analysis of the same standard calibration compound identified for FIG. 1 using an electropolished, gold-electroplated stainless steel EI ionization source embodiment of this invention in the same MS instrument identified for FIG. 1.

FIG. 2 is a graph showing analysis of the same standard calibration compound identified for FIG. 1 using an electropolished, gold-electroplated stainless steel EI ionization source embodiment of this invention in the same MS instrument described for FIG. 1. The standard calibration compound and the interpretation for the legend below the graph are as described for FIG. 1. As can be seen by comparing the graphs of FIGS. 1 and 2, the tuning and mass transmission quality of the spectral pattern using the electropolished, gold-electroplated stainless steel ionization source embodiment of this invention provides increased transmitted mass, allowing better library searching, and enhanced tuning for the MS as compared to use of a conventional stainless steel ionization source. Using the electropolished, gold-electroplated stainless steel EI ionization source embodiment of this invention, the MS is tuned for higher sensitivity and efficiency.

Figure 3:
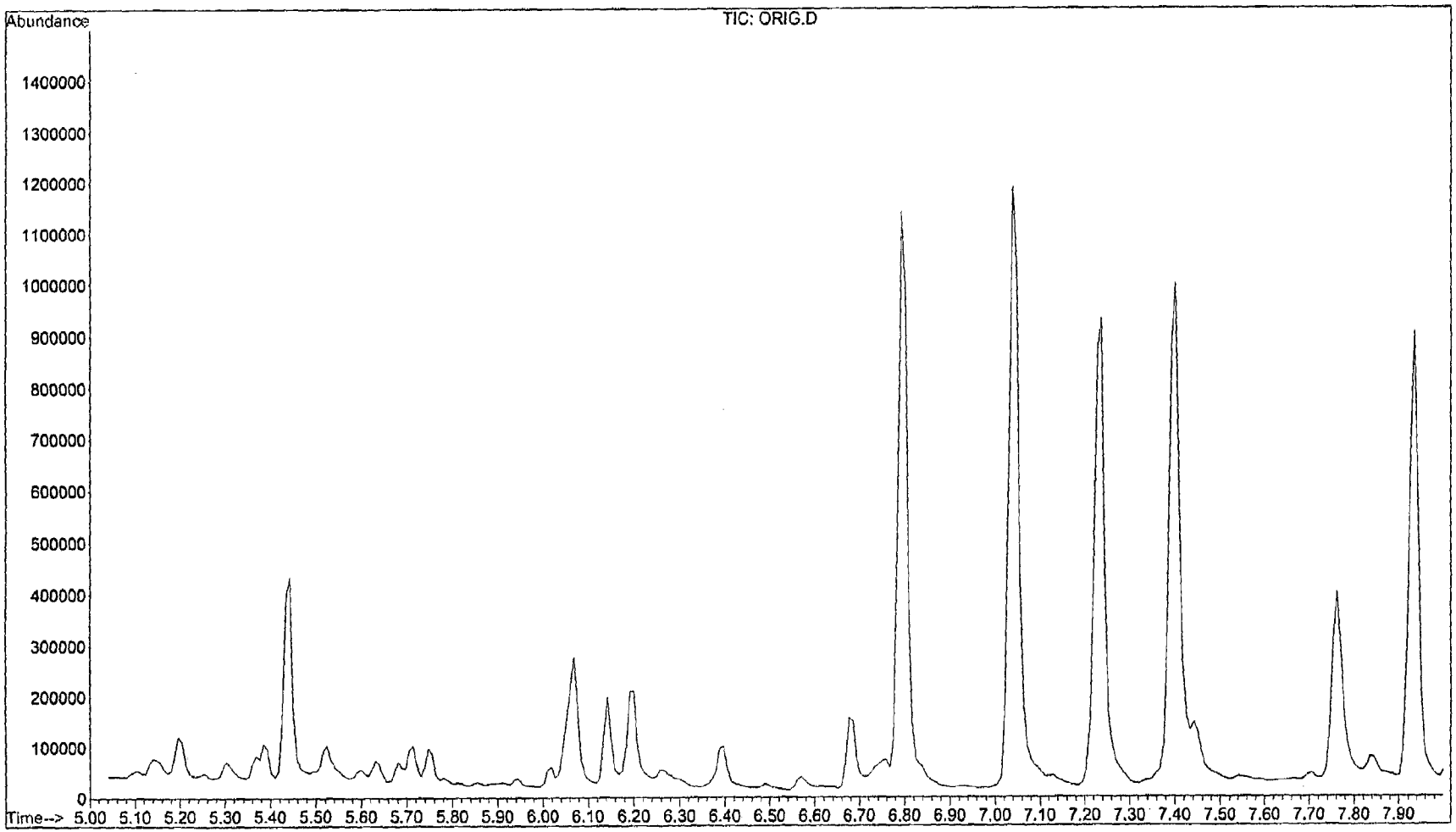
FIG. 3 is a graph showing analysis of a typical food and drug analysis standard used for governmental food inspections, using a conventional stainless steel EI ionization source in an MS instrument.

FIG. 3 is a graph showing analysis of 10 parts per million (ppm) of a typical food and drug analysis standard used by Canadian national government agencies for food inspections, using a conventional stainless steel EI ionization source in a 5972A MS instrument, manufactured by Agilent Technologies, Wilmington, Del. Data displayed in FIG. 3 is for a selected portion or time period of a chromatographic run to display graphically a portion of the analysis of this standard.

Figure 4:
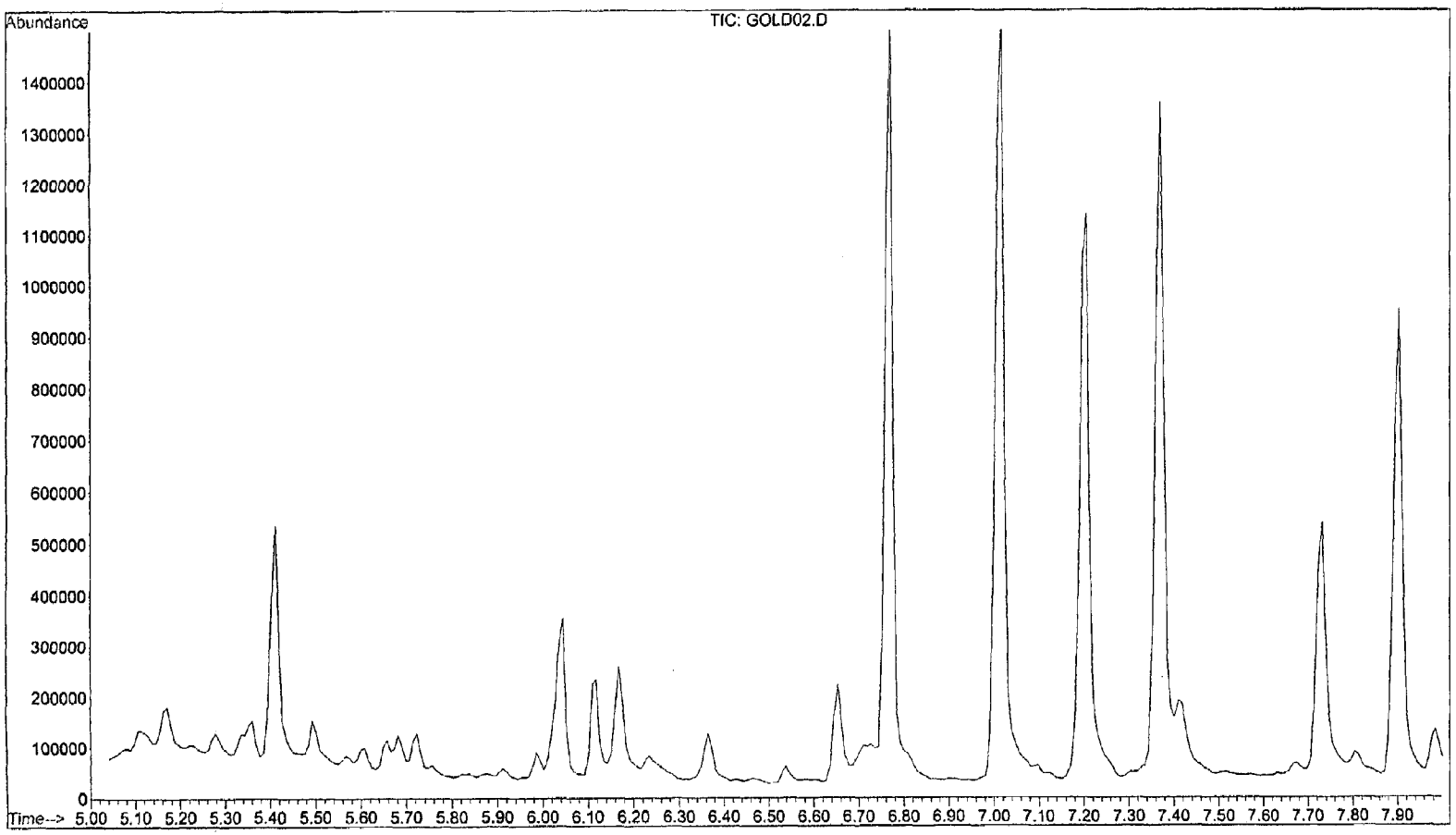
FIG. 4 is a graph showing analysis of the same food and drug analysis standard identified for FIG. 3, using an electropolished and gold-electroplated EI ionization source in the same MS instrument identified for FIG. 3.

FIG. 4 is a graph showing analysis of 10 ppm of the same food and drug analysis standard as described for FIG. 3, using an electropolished, gold-electroplated EI ionization source in the same MS instrument identified for FIG. 3. Data displayed in FIG. 4 is for the same selected time period as shown in FIG. 3 during a chromatographic run to display graphically the same portion of the analysis of this same standard, using an ionization source embodiment of this invention. A comparison of FIGS. 3 and 4 shows increased response and improved signal-to-noise using the electropolished, gold-electroplated ionization source (FIG. 4) as compared to the conventional stainless steel ionization source (FIG. 3). FIG. 4 shows improved (lower) detectable limits for the compounds in this standard using the electropolished, gold-electroplated ionization source.

All ionization sources require cleaning after an extended period of use. Cleaning of conventional ionization sources typically requires mechanical abrasion, such as vigorous mechanical cleaning, abrasives, such as abrasive paper, alumina abrasive powder, sand blasting, and the like, and cleaning solvents, such as acetone, methanol, methylene chloride and the like. Such cleaning techniques are necessary to rehabilitate a conventional ionization source after extended use. Mechanical cleaning may often result in deformation or even breakage of the components, resulting in unwanted expense, time and effort. The novel EI ionization source embodiment of this invention has been found not to need cleaning as often. In addition, when cleaning is needed to bring the performance of the MS back to initial levels, it has been found that the source is easier to recondition. Reconditioning can be done with non-abrasive cleaning in conventional protic acid, such as sulfuric acid of about 3 N, and then rinsing with deionized water. The smooth ionization source surface combined with an inert surface result in a surface that does not need physical abrasion to clean and recondition. Thus, no mechanical deformation of parts occurs in the process of cleaning or rehabilitating the inventive EI ionization source embodiment. The inert surface permits more reactive cleaning solvents than possible with stainless steel surfaces. Acid cleaning of conventional stainless steel ionization sources could etch and deform the steel, resulting in reduced ion beam efficiency upon reuse in an MS.

While aspects of this invention have been described and illustrated with reference to specific embodiments, those skilled in the art will recognize that modification and variations may be made without departing from the principles of the invention as described herein above. For example, although this invention has been exemplified with reference to an electron impact (EI) ionization source, similar advantages and improvements may result from the application of these principles to other ionization sources, including, for example, chemical ionization (CI), negative chemical ionization (NID), fast ion or atom bombardment, field desorption, laser desorption, plasma desorption, thermospray, electrospray and inductively coupled plasma, and the like. The full limits of this invention are as set forth in the following claims.

I claim:

1. An improved ionization source for a mass spectrometer, comprising, an ionization element with a surface that is chemically inert and has a finish resembling one selected from electropolished, chemical passivation polished, mechanical abrasive polished, cylindered, honed, and metal-to-metal polished finishes, wherein the ionization source is less prone to analyte contamination than those previously known.

2. The source of claim 1 wherein the element is an ionization chamber.

3. The source of claim 1 wherein the surface comprises a subsurface with an upper surface having a first finish, the finish selected from electropolished, chemical passivation polished, mechanical abrasive polished, cylindered, honed, and metal-to-metal polished finishes, and a top surface that is chemically inert, the top surface having an underside proximate to first finish and a top side opposed to first finish and with a topside finish that substantially replicates the first finish.

4. The source of claim 3 wherein the subsurface further comprises an under surface beneath and proximate the first finish, the under surface having a finish comprising a micro-machined finish.

5. The source of claim 3 wherein the top surface has a thickness of less than 0.001 inches.

6. The source of claim 3 wherein the top surface has a thickness of less than 0.0001 inches.

7. The source of claim 1 wherein the surface is selected from the group consisting of gold, platinum, chromium, nickel and mixtures and alloys thereof.

8. The source of claim 1 wherein the source is selected from electron impact, chemical ionization, negative chemical ionization, fast ion and atom bombardment, field desorption, laser desorption, plasma desorption, thermospray, electrospray, and inductively coupled plasma ionization sources.

9. The source of claim 1 wherein the source is an electron impact ionization source.

10. An improved ionization source for a mass spectrometer, comprising, an ionization element with a surface that is chemically inert and has a finish resembling one selected from electropolished, chemical passivation polished, mechanical abrasive polished, cylindered, honed, and metal-to-metal polished finishes, the surface, comprising, a subsurface with an upper surface having a first finish, the finish selected from electropolished, chemical passivation polished, mechanical abrasive polished, cylindered, honed, and metal-to-metal polished finishes, and a top surface that is chemically inert, the top surface having an underside proximate to first finish, a top side opposed to first finish and a thickness of less than 0.001 inches.

11. The source of claim 10, further comprising, an under surface beneath and proximate the first finish, the under surface having a finish comprising a micro-machined finish.

12. The source of claim 10 wherein the top surface is electroplated gold.

13. A method of making an ionization element for a mass spectrometer, comprising, providing a first finish on the element using a process selected from electropolished, chemical passivation polished, mechanical abrasive polished, cylindered, honed, and metal-to-metal polished finishes; and applying a chemically inert surface on the first finish of the element in a manner that substantially replicates the first finish on to the side of the inert surface opposing the first finish.

14. The method of claim 13, wherein the chemically inert surface is gold and the thickness of the surface is less than 0.001 inches.

15. The method of claim 13, wherein the chemically inert surface is gold and the thickness of the surface is less than 0.0001 inches.

16. A method of cleaning an ionization element of a mass spectrometer contaminated with analyte-generated contamination, comprising, providing an improved ionization element comprising a surface that is chemically inert and has a finish resembling one selected from electropolished, chemical passivation polished, mechanical abrasive polished, cylindered, honed, and metal-to-metal polished finishes, and applying solvent to remove analyte-generated contamination without the need for physical abrasion with abrasive materials.

17. The method of claim 16 wherein the surface comprises a subsurface with an upper surface having a first finish selected from electropolished, chemical passivation polished, mechanical abrasive polished, cylindered, honed, and metal-to-metal polished finishes, and a top surface that is chemically inert and has a thickness that is thin enough to be able to substantially replicate the first finish on the side of the inert surface opposing the first finish.

18. The method of claim 16 wherein the chemically inert surface is gold with a thickness of less than 0.001 inches.

* * * * *